United States Patent [19]

Kawakami et al.

[11] Patent Number: 4,885,271

[45] Date of Patent: Dec. 5, 1989

[54] HEAT-SENSITIVE RECORDING MATERIAL

[75] Inventors: Hiroshi Kawakami; Akira Igarashi, both of Shizuoka, Japan

[73] Assignee: Fuji Photo Film Co., Ltd., Kanagawa, Japan

[21] Appl. No.: 11,480

[22] Filed: Feb. 5, 1987

[30] Foreign Application Priority Data

Feb. 5, 1986 [JP] Japan ..... 61-23465

[51] Int. Cl.[4] ..... B41M 5/18

[52] U.S. Cl. ..... 503/214; 427/152; 428/913; 428/914; 503/200; 503/226

[58] Field of Search ..... 427/150–152; 503/200, 214, 226; 428/913, 914

[56] References Cited

U.S. PATENT DOCUMENTS

| | | | |
|---|---|---|---|
| 4,370,370 | 1/1983 | Iwata et al. | 503/226 |
| 4,590,499 | 5/1986 | Fujimura et al. | 503/200 |
| 4,614,956 | 9/1986 | Miyauchi | 503/209 |

FOREIGN PATENT DOCUMENTS

| | | | |
|---|---|---|---|
| 1025884 | 2/1986 | Japan | 503/226 |
| 2119531 | 11/1983 | United Kingdom | 503/209 |
| 2121207 | 12/1983 | United Kingdom | 503/209 |
| 2132784 | 7/1984 | United Kingdom | 503/209 |

*Primary Examiner*—Bruce H. Hess

[57] ABSTRACT

A heat-sensitive recording material is disclosed. The material comprises a support having provided thereon a heat-sensitive color-forming layer containing a colorless or slightly colored electron donating dye precursor and an electron accepting compound which is capable of forming color by reaction with the said electron donating dye precursor, wherein said color-forming layer has provided thereon a protective layer containing a binder and said color-forming layer contains a hardening agent which is capable of hardening said binder in the protective layer by reaction with said binder.

16 Claims, No Drawings

HEAT-SENSITIVE RECORDING MATERIAL

FIELD OF THE INVENTION

The present invention relates to a heat-sensitive recording material, and more particularly, to a heat-sensitive recording material using color forming reaction between a colorless or slightly colored electron donating dye precursor and an electron accepting compound.

BACKGROUND OF THE INVENTION

A so-called two-component type heat-sensitive recording material using color forming reaction between a colorless or slightly colored electron donating dye precursor and an electron accepting compound is disclosed in Japanese Patent Publication Nos. 14039/70 (corresponding to U.S. Pat. No 3,539,375) and 4160/68 and so on. A two-component color forming type heat-sensitive recording material is prepared by dispersing a colorless or slightly colored electron donating dye precursor and an electron accepting compound into a fine particle state, mixing a binder and the like therewith so that these two heat-sensitive compounds are separated and coating the mixture on a support. One or both these heat-sensitive compounds are fused and contacted each other upon heating, resulting in a color forming reaction to conduct recording. Such two-component color forming type heat-sensitive recording material are advantageous in such points that: (1) primary coloration is conducted and therefore development is unnecessary; (2) paper quality is similar to that of a general paper; (3) handling is easy; (4) color density is high; and (5) upon color formation various hues can be obtained, and accordingly such recording material is very valuable. Therefore, the two-component color forming type heat-sensitive recording material has become widely used, particularly recently in the fields of facsimile, recorders, and printers. With the increased wide usage in the field of facsimile, recording rate is made higher and higher. And with this tendency, a heat-sensitive recording material has been strongly demanded to have short pulse, that is, color formation with low energy, that is, improvement of heat reactivity, has been strongly demanded.

On the other hand, the heat-sensitive recording materials typically have defects such as that an electron donating-dye precursor and an electron accepting compound are apt to react not only upon heating but also by action of solvents, because the recording materials utilize primary coloration.

These two compounds react in a solvent, because they are organic compounds and have high solubility to a solvent. For the above reason, white part of a heat-sensitive recording material is apt to form color when contacted with a writing material containing a solvent, such as an aqueous ink pen, an oily ink pen, a fluoroscent ink pen, a diazo developing solution or an adhesive, and printed letters of the heat-sensitive recording material are apt to disappear, resulting in largely decreased commercial value thereof.

In order to overcome the above problems, provision of a solvent-resistant protective layer on the heat-sensitive color forming layer has been proposed in the past. However, such a protective layer has not always been satisfactory because it is not sufficiently water-resistant, that is, the protective layer peels off from the heat-sensitive color forming layer or the protective layer itself dissolves when the heat-sensitive recording material is dipped in a water.

SUMMARY OF THE INVENTION

Therefore, an object of the present invention is to provide a heat-sensitive recording material comprising a heat-sensitive color forming layer having provided thereon a solvent-resistant protective layer having excellent water-resistance.

The object of the present invention can be attained by a heat-sensitive recording material comprising a support having provided thereon a heat-sensitive color forming layer containing a colorless or slightly colored electron donating dye precursor and an electron accepting compound which is capable of forming color by reaction with said electron donating dye precursor, wherein said color forming layer has provided thereon a protective layer containing a binder and said color forming layer contains a hardening agent which is capable of hardening said binder in the protective layer by reaction with the binder.

DETAILED DESCRIPTION OF THE INVENTION

The binder contained in the protective layer is preferably a water-soluble polymer in view of solventresistance, such as methyl cellulose, carboxymethyl cellulose, hydroxyethyl cellulose, starches, gelatin, gum arabic, casein, a hydrolysis product of styrene-maleic anhydride copolymer, a hydrolysis product of ethylenemaleic anhydride copolymer, a hydrolysis product of isobutylene-maleic anhydride copolymer, polyvinyl alcohol, carboxy-modified polyvinyl alcohol, silanol-modified polyvinyl alcohol, and polyacrylamide. Among those particularly polyvinyl alcohol, carboxy-modified polyvinyl alcohol and silanol-modified polyvinyl alcohol are preferred. Further, latexes such as styrene-butadiene latex and acrylonitrile latex and the like can also be used.

The binder is used in an amount of from 0.5 to 2.5 $g/m^2$, preferably, from 0.7 to 2.0 $g/m^2$.

The hardening agent contained in a heat-sensitive color forming layer of the present invention is water-soluble initially condensed resins such as N-methylol urea, N-methylol melamine, urea-formaldehyde, benzoguanamine-formaldehyde or acetoguanamine-formaldehyde; dialdehyde compounds such as glyoxal or glutaraldehyde; inorganic crossliking agents such as boric acid or borax; polyacrylic acid, methylvinylether-maleic acid copolymer, and isobutylene-maleic anhydride copolymer. Particularly N-methylol melamine, a dialdehyde compound, and initial condensate of urea-formaldehyde are preferred. The amount of the hardening agent to be used is preferably from 0.5 to 30 wt %, and more preferably from 2 to 10 wt %, based on the weight of the binder in the protective layer.

In addition to the binder, pigments, metal soaps, waxes and the like can be incorporated into the protective layer for the purpose of preventing adhesion with a thermal head.

Specific examples of the pigments include zinc oxide, calcium carbonate, barium sulfate, titanium oxide, lithopone, talc, agalmatolite, kaolin, alminum hydroxide, silica, amorphous silica, and colloidal silica. The additive amount thereof is from 0.2 to 4 times of the binder.

Specific examples of the metal soaps include/emulsions of higher fatty acid metal salts such as zinc stearate, calcium stearate and aluminum stearate, and particularly zinc stearate is preferred. The additive amount thereof is generally from 0.5 to 20 wt %, and more preferably from 1 to 10 wt %, based on the total weight of the protective layer.

Specific examples of the waxes include emulsions of paraffin wax, micro crystalline wax, carnauba wax, methylolstearoamide, stearic acid amide, polyethylene wax and polystyrene wax. The additive amount is preferably from 1 to 20 wt %, and more preferably from 1 to 10 wt % based on the total weight of the protective layer.

Upon coating a protective layer on a heat-sensitive color forming layer, a surface active agent can be added to prepare a homogeneous protective layer. Surface active agents that can be used include a surface active agent of alkali metal salts of sulfosuccinic acid, and a fluorine-containing surface active agent. Specific examples are sodium salts or ammonium solts of di-(2ethylhexyl)sulfosuccinic acid, di-(n-hexyl)sulfosuccinic acid and the like and any anionic surface active agents can be effective.

The colorless or slightly colored electron donating dye precursors used in the present invention include triarylmethane compounds, diphenylmethane compounds, xanthene compounds, thiazine compounds and spiropyran compounds. Specific examples thereof are those as disclosed in Japanese Patent Application (OPI) No. 27253/80 (corresponding to U.S. Pat. No. 4,283,458) (the term "OPI" as used herein means an "unexamined published application"), for example, triarylmethane compounds such as 3,3-bis(p-dimethylaminophenyl)-6-dimethylaminophthalide (that is, Crystal Violet Lactone), 3,3-bis(p-dimethylaminophenyl)phtalide, 3-(p-dimethylaminophenyl)-3-(1,3-dimethylindol-3-yl)phthalide or b 3-(p-dimethylaminophenyl)-3-(2-methylindol-3-yl)phthalide; diphenylmethane compounds such as 4,4'-bis-dimethylaminobenzhydrin benzylether, N-halophenyl-leucoauramine or N-2,4,5-trichlorophenyl leucoauramine; xanthene compounds such as rhodamine-B-anilinolactam, rhodamine(p-nitrino)lactam, 2(dibenzylamino)fluoran, 2-phenylamino-6-diethylaminofluoran, 2-(o-chloroanilino)-6-diethylaminofluoran, 2-(3, 4-dichloroanilino)-6-diethylaminofluoran, 2-anilino-3-methyl-6-pyperidinylfluoran or 2-phenyl-6-diethylaminofluoran; thiazine compounds such as benzoyl leucomethylene blue, p-nitrobenzyl leucomethylene blue; and spiro compounds such as 3-methyl-spiro-dinaphthopyran, 3ethylspiro-dinaphthopyran, b 3,3-dichlorospiro-dinaphthopyran, 3-benzylspiro-dinaphthopyran, 3-methyl-naphtho-(3-methoxybenzo)spiropyran or 3-propyl-spiro-dibenzopyran. These compounds can be used alone or in combination. Among these compounds, triaryl methane compounds (such as Crystal Violet Lactone) and xanthene compounds are preferred because most of them have reduced fog and have high color density. More preferred compounds are xanthene compounds represented by formula (I)

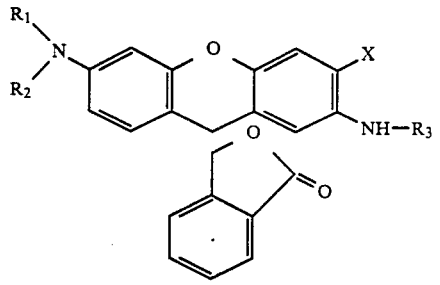

(I)

wherein $R_1$ and $R_2$ each represents an alkyl group or a cycloalkyl group having from 1 to 10 carbon atoms, $R_3$ represents an aryl group and X represents an alkyl group having from 1 to 10 carbon atoms or a halogen atom.

In formula (I), an alkyl group represented by $R_1$ and $R_2$ can be a straight chain or a branched chain, and can be substituted with a halogen atom, an alkyl group, an aryl group, an aralkyl group and the like. An aryl group represented by $R_3$ is preferably an aryl group having from 6 to 20 carbon atoms and is preferably a substituted or unsubstituted phenyl group. A substituent of a phenyl group is preferably an alkyl group having from 1 to 10 carbon atoms.

In the dye precursors represented by formula (I), particularly preferred precursors are represented by formula (II)

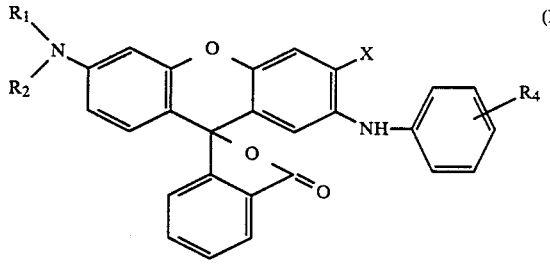

(II)

wherein $R_1$ and $R_2$ each represents an alkyl group having from 1 to 10 carbon atoms, $R_4$ represents a hydrogen atom or an alkyl group having from 1 to 8 carbon atoms and X represents an alkyl group having from 1 to 8 carbon atoms or a chlorine atom.

In formula (II), an alkyl group represented by $R_1$ and $R_2$ can form a ring, and can further have a substituent as designated in formula (I).

In formula (II), the compounds wherein X is a methyl group or a chlorine atom are particularly preferred.

Specific examples of colorless and slightly colored electron donating dye precursors are illustrated below, but the invention is not limited thereto.

There may be mentioned 2-anilino-3-methyl-6-dimethylaminofluoran, 2-anilino-3-methyl-6-N-methyl-N-ethylaminofluoran, 2-anilino-3-methyl-6-N-methyl-N-(iso-propyl)aminofluoran, 2-anilito-3-methyl-6-N-methyl-N-pentylaminofluoran, 2-anilino-3-methyl-6-N-methyl-N-cyclo-hexylaminofluoran, 2-anilino-3-methyl-6-diethylamino-fluoran, 2-anilino-3-chloro-6-dimethylaminofluoran, 2-anilino-3-methyl-6-N-ethyl-N-isoamylaminofluoran, 2-anilino-3-methyl-6-N-methyl-N-isoamylaminofluoran, 2-anilino-3-chloro-6-diethylaminofluoran, 2-anilino-3-chloro-6-N-methyl-N-ethylaminofluoran, 2-anilino-3-chloro-6-N-methyl-N-

(isopropyl)aminofluoran, 2-anilino-3-chloro-6-N-methyl-N-pentylaminofluoran, 2-anilino-3-chloro 6-N-metnyl-N-cyclohexylaminofluoran, 2-anilino-3-methyl-6-N-ethyl-N-pentylaminofluoran, 2-anilino-3-chloro-6-N-ethyl-N-pentylaminofluoran, 2-(p-methylanilino)-3-methyl-6dimethylaminofluoran, 2-(p-methylanilino)-3-methyl-6diethylaminofluoran, 2-(p-methylanilino)-3-methyl-6-N-methyl-N-ethylaminofluoran, 2-(p-methylanilino)-3-methyl-6-N-methyl-N-(isopropyl-)aminofluoran, 2-(p-methylanilino)-3-methyl-6-N-methyl-N-pentylaminofluoran, 2-(p-methylanilino)-3-methyl-6-N-methyl-N-cyclohexylaminofluoran, 2-(p-methylanilino)-3-methyl-6-N-ethyl-N-pentylaminofluoran, 2-(p-methylanilino)-3-chloro-6-dimethyl-N-ethylaminofluoran, 2-(p-methylanilino-3-chloro-6-diethylaminofluoran, 2-(P-methylanilino)-3-chloro-6-N-methyl-N-ethylaminofluoran, 2 -(p-methylanilino)-3-chloro-6-N-methyl-N-(isopropyl)aminofluoran, 2-(p-methylanilino)-3-chloro-6-N-methyl-N-cyclohexylaminofluoran, 2-(p-methylanilino)-3-chloro-6-N-methyl-N-pentylaminofluoran, 2-(p-methylanilino)-3-chloro6-N-ethyl-N-pentylaminofluoran, 2-anilino-3-methyl-6-N-methyl-N-furylmethylaminofluoran, and 2-anilino-3-ethyl-6-N-metnyl-N-furylmethylaminofluoran, and these compounds can be used alone, or can be used in combination for the purpose of adjusting color tone and preventing discoloration of colored images.

The electron donating dye precursor is used in an amount of from 0.2 to 1.0 g/m$^2$, preferably, from 0.25 to 0.75 g/m$^2$.

The electron accepting compounds used in the present invention are preferably those compounds represented by formulae (III) to (VII)

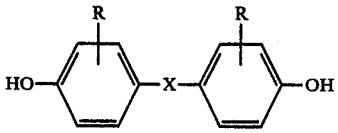

(III)

In formula (III), X represents S,O,$SO_2$, $S_2$,

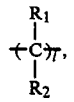

represents an integer of from 0 to 3, $R_1$ *and* $R_2$ each represents a hydrogen atom or an alkyl group having from 1 to 8 carbon atoms, or $R_1$ and $R_2$ combine to form a cycloalkyl group, and R represents a straight or branched alkyl group having from 1 to 8 carbon atoms or a halogen atom.

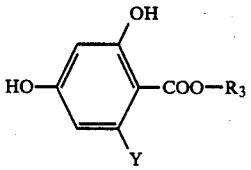

(IV)

In formula (IV), Y represents a hydrogen atom, —$CH_3$ or OH, $R_3$ represents

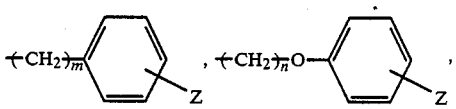

or a straight or branched alkyl group having from 1 to 6 carbon atoms, m and n each represents an integer of from 0 to 3, Z represents a hydrogen atom, a halogen atom, or —$CH_3$.

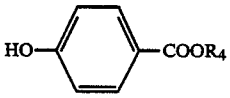

(V)

In formula (V), $R_4$ represents a benzyl group, a benzyl group substituted with a halogen atom or a straight or branched alkyl group having from 1 to 8 carbon atoms, or a straight or a branched alkyl group having from 1 to 8 carbon atoms.

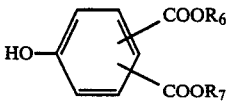

(VI)

In formula (VI), $R_6$ and $R_7$ each represents an alkyl group having from 1 to 8 carbon atoms.

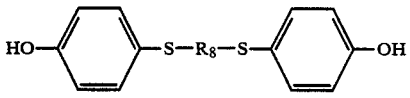

(VII)

In formula (VII), $R_8$ represents an alkylene group having from 1 to 5 ether bonds.

Specific examples of compounds represented by formula (III) to (VII) include, 2,2-bis(4'-hydroxyphenyl)-propane, 2,2-bis(4'-hydroxypheyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxypheyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)-2-methylpentane, 1,1-bis(4'-hydroxyphenyl)-2-ethylhexane, 1,1-bis(4'-hydroxyphenyl)dodecane, 3,3-bis(4'-hydroxyphenyl)pentane, 1,2-bis(4'-hydroxyphenyl)ethane, 1,1-bis(4' -hydroxyphenyl)sulfite, 1,1-bis(4'-hydroxyphenyl)sulfon, 1,1-bis(4'-hydroxyphenyl)ether, 2,2-bis(4'-hydroxy-3',5'-dichlorophenyl)-butane, phenyl 2,4-dihydroxybenzoate, phenyl 2,4-dihydroxy-4'-methylbenzoate, phenyl 2,4-dihydroxy-4'-chlorobenzoate, phenyl 2,4-dihydroxy-6-methylbenzoate, phenyl 2,4,6-trihydroxybenzoate, phenyl 2,4-dihydroxy-6,4'-dimethylbenzoate, phenyl 2,4-dihydroxy6-methyl-4'-chlorobenzoate, benzyl 2,4-dihydroxybenzoate, benzyl 2,4-dihydroxy-4'-methylbenzoate, benzyl 2,4-dihydroxy-4'-chlorobenzoate, benzyl 2,4-dihydroxy-6-methylbenzoate, benzyl 2,4,6-trihydroxybenzoate, benzyl 2,4-dihydroxy-6,4'-dimethylbenzoate, benzyl 2,4-dihydroxy6-methyl-4'-chlorobenzoate, ethyl 4-hydroxybenzoate, propyl 4-hydroxybenzoate, isopropyl 4-hydroxybenzoate, benzyl 4-hydroxybenzoate, 2-ethylhexyl 4-hydroxybenzoate, benzyl 4-hydroxy-4'- chlorobenzoate, benzyl 4-hydroxy-4'-methylbenzoate, benzyl 4-hydroxy-4'-ethylbenzoate, dimethyl 3-hydroxy-m-phtahlate, diethyl 3-hydroxy-m-phthalate, methylethyl 3-hydroxy-m-phtahlate, dibutyl 3-hydroxy-m-phthalate, dimethyl 3-hydroxy-o-phthalate, diethyl 3-hydroxy-o-phtahlate, and the like.

Specific examples of compounds represented by formula (VII) are

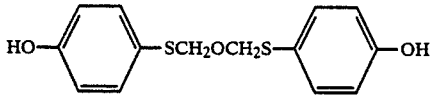

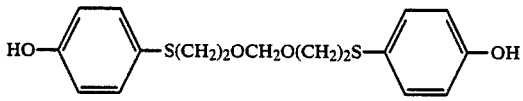

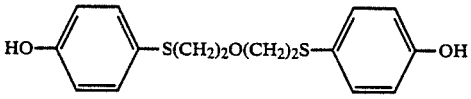

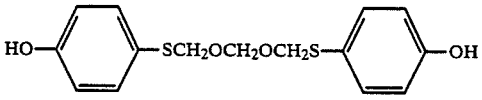

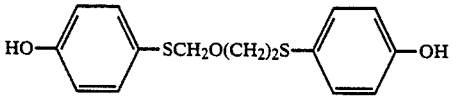

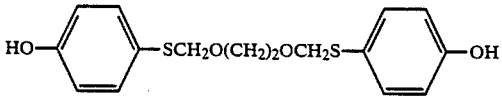

Preferable examples of useful electron accepting compounds besides those represented by formulae (III) to (VII) include bis-hydroxycumylbenzene or bis-hydroxy methylbenzyl benzenes, such as 1,4-bis-p-hydroxycumylbenzene, 1,4-bis-m-hydroxy-cumylbenzene, 1,3-bis-p-hydroxycumylbenzene, 1,3-bis-m-hydroxycumylbenzene, 1,4-bis-o-hydroxycumylbenzene, 1,4-bis-p-hydroxy-α-methyl benzylbenzene, 1,3-bis-p-hydroxy-α-methylbenzylbenzene, salicylic acid derivatives such as 3,5-di-α-methylbenzyl salicylic acid, 3,5-di-tertiary-butyl salicylic acid and 3-α,α-dimethylbenzyl salicylic acid and polymetal salts thereof (metals are preferably zinc and aluminum). In addition thereto, there are phenols such as p-phenylphenol, 3,5-diphenylphenol or cumylphenol, and preferred compounds are not limited thereto.

The above-described electron accepting compounds can preferably be used in an amount of from 50 to 1,000 wt %, and more preferably from 100 to 500 wt %, based on the weight of the electron donating dye precursors, and they can be used alone or in combination.

In the heat-sensitive recording material of the present invention, a heat meltable substance can be incorporated into the heat-sensitive color forming layer in order to improve heat responsiveness.

Preferred examples of the heat meltable substance are compounds represented by formulae (VIII) to (XIII)

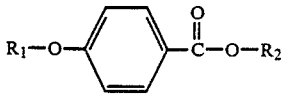

(VIII)

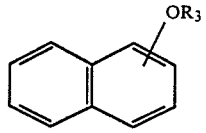

(IX)

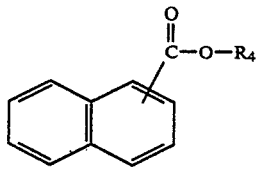

(X)

$R_5NHCONH_2$ (XI)

$R_6CONH—R_7$ (XIII)

In the formulae (VIII) to (XII), $R_1$, $R_2$, $R_3$ and $R_4$ each represents a phenyl group, a benzyl group, which can be substituted with a lower alkyl group, a halogen atom, a hydroxy group or an alkoxy group. $R_5$ and $R_6$ each represents an alkyl group having from 12 to 24 carbon atoms and $R_7$ represents a hydrogen atom or a phenyl group.

When a phenyl group or a benzyl group represented by $R_1$, $R_2$,$R_3$ and $R_4$ in formulae (VIII) to (X) is substituted with a lower alkyl group, the number of carbon atoms thereof is generally from 1 to 8, and preferably from 1 to 3. When they are substituted with a halogen atom, it is preferably a chlorine or fluorine atom.

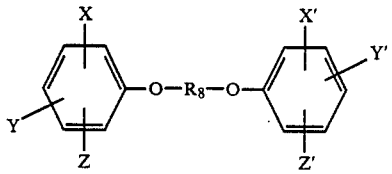

(XIII)

wherein $R_8$ represents a divalent group, preferably an alkylene group, alkylene group having an ether bond, an alkylene group having a carbonyl group, an alkylene group having an halogen atom, an alkylene group having an unsaturated bond and an alkylene group having a ether bond are more preferred. X, Y, Z, X', Y' and Z' may be the same or different and each represents a hydrogen atom, an alkyl group, a lower alkoxy group, a lower aralkyl group, a halogen atom, an alkyloxycarbonyl group and an aralkyloxycarbonyl group.

The compounds represented by the above-described formulae (VIII) to (XIII) have a melting point of, preferably, from 70° to 150° C., and more preferably from 80° to 130° C.

Specific examples of the above compounds include benzyl p-benzyloxybenzoate, β-naphthylbenzyl ether, stearic acid amide, palmitic acid amide, N-phenyl stearic acid amide, stearylurea, phenyl β-naphthoate, phenyl 1-hydroxy-2-naphthoate, β-naphthol(p-chlorobenzyl)ether, β-naphthol(p-methylbenzyl)ether, α-naphthylbenzyl ether, 1,4-butandiol-di-p-methylphenyl ether, 1,4-propanediol-di-p-methylphenyl ether, 1,4-butandiol-p-isopropyl-phenylether, 1,4-butandiol-di-p-t-octylphenyl ether, 2-phenoxy-1-p-tolyloxyethane, 1-phenoxy-2-(4-ethylphenoxy)-ethane, 1-phenoxy-2-(4-chlorophenoxy)ethane and 1,4-butanediol diphenyl ether.

The above-described heat meltable compounds can be used alone or in combination, and can be used in an amount of from 10 to 200 wt %, and preferably from 20 to 150 wt %, based on the weight of the electron accepting compounds, in order to obtain sufficient heat responsiveness.

In a two component type heat-sensitive recording material using an electron donating dye precursor and an electron accepting compound, the recorded images obtained generally tend to disappear over time due to the influence of ambient conditions such as humidity and heat.

In a heat-sensitive recording material of the present invention, it is preferred that compounds capable of preventing image disappearince and of making formed images fast can be incorporated into the heat-sensitive color forming layer.

As such color disappearance-preventing agents, phenol derivatives, and particularly hindered phenol compounds are effetive. Preferable examples of those compounds are compounds represented by formulae (XIV) to (XVII).

(XIV)

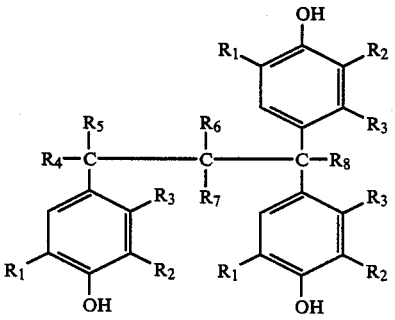

In formula (XIV), $R_1$ represents a branched alkyl group having from 3 to 8 atoms, $R_2$ represents a hydrogen atom or a branched alkyl group having from 3 to 8 carbon atoms, $R_3$ represents a hydrogen atom or an alkyl group having from 1 to 3 carbon atoms, $R_4$ represents a hydrogen a hydrogen atom or an alkyl group having from 1 to 8 carbon atoms, $R_5$, $R_6$, and $R_7$ each represents a hydrogen atom or an alkyl group having from 1 to 3 carbon atoms, and $R_8$ represents a hydrogen atom or an alkyl group having from 1 to 8 carbon atoms.

(XV)

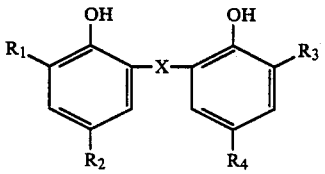

In formula (XV), $R_1$ and $R_3$ each represents a branched alkyl group having from 3 to 8 carbon atoms, $R_2$ and $R_4$ each represents an alkyl group having from 1 to 8 carbon atoms, X represents S, O, $SO_2$, $S_2$,

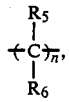

wherein n represents an integer of from 0 to 3, a cyclopentylene group, or a cyclohexylene group, and $R_5$ and $R_6$ each represents a hydrogen atom or an alkyl group having from 1 to 8 atoms.

(XVI)

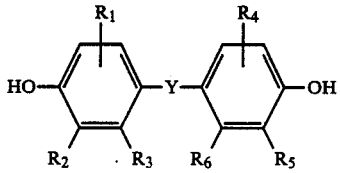

In formula (XVI), $R_1$ and $R_4$ each represents a branched alkyl group having from 3 to 8 carbon atoms, $R_2$, $R_3$, $R_5$, and $R_6$ each represents a hydrogen atom or an alkyl group having from 1 to 8 carbon atoms, Y represents S, O, $SO_2$, $S_2$,

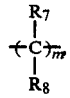

wherein m is an integer of from 0 to 3, $R_7$ and $R_8$ each represents a hydrogen atom or an alkyl group having from 1 to 8 carbon atoms, or $R_7$ and $R_8$ bond to form a cyclic pentamethylene group.

(XVII)

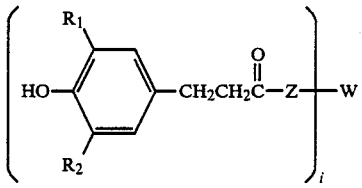

In formula (XVII), $R_1$ and $R_2$ each represents branched alkyl group having from 3 to 8 carbon atoms, Z represents —NH—, —O$(CH_2)_n$—, wherein n represents an integer of from 1 to 5, i represents an integer of from 1 to 4, and when i is 1, W represents an alkyl group having from 1 to 18 carbon atoms, and when i is 2, W represents S,O,

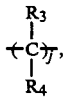

wherein $R_3$ and $R_4$ each represents a hydrogen atom or an alkyl group having from 1 to 8 carbon atoms, j represents an integer of from 0 to 8, and when i is 3, W represents —C—$R_5$, wherein $R_5$ represents a hydrogen atom or an alkyl group having from 1 to 8 carbon aboms, and when i is 4, W represents —C—.

The typical examples of phenol derivatives represented by formulae (XIV) to (XVII) are shown below.

(A) The phenol derivatives as shown by formula (XIV) include 1,1,3-tris(2-methyl-4-hydroxy-5-tert-butylphenyl)butane, 1,1,3-tris(2-ethyl-4-hydroxy-5-tert-butylphenyl)butane, 1,1,3-tris(3,5-di-tert-butyl-4-hydroxyphenyl)butane, and 1,1,3-tris(2-methyl-4-hydroxy-5-tertbutylphenyl)propane.

(B) The pheno derivatives as shown by formula (XV) include 2,2'm-methylene-bis(6-tert-butyl-4-methylphenol) and 2,2'-methylene-bis(6-tert-butyl-4-ethylphenol).

(C) The phenol derivatives as shown by formula (XVI) include 4,4'-butylidene-bis(6-tert-butyl-3-methylphenol) and 4,4'-thio-bis(3-methyl-6-tert-butylphenol).

(D) The phenol derivatives as shown by formula (XVII) include

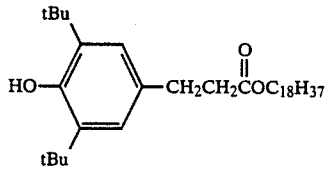

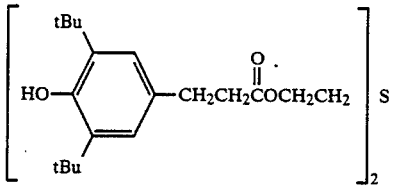

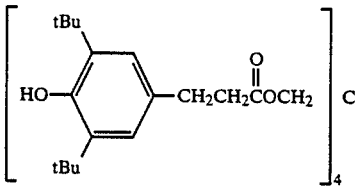

The additive amount of the phenol compounds represented by formulae (XIV) to (XVII) is preferably from 1 to 200 wt %, and more preferably from 5 to 50 wt %, based on the weight of the electron accepting compound.

Into the heat-sensitive color-forming layer of the heat-sensitive recording material of the present invention can be further added binders, pigments, metal soaps, waxes, surface active agents, and the like, which can also be added into the above-described protective layer.

The heat-sensitive color-forming layer of the present invention is coated on a support in an amount of from 2 to 15 g/m$^2$, preferably, from 3 to 10 g/m$^2$ as solid basis. The protective layer of the present invention is coated on the heat-sensitive color-forming layer in an amount of from 0.5 to 7 g/m$^2$, preferably, from 1 to 5 g/m$^2$ as solid basis.

As a support, a paper such as a wood free paper, synthesized paper and transparent film can be used. An under-coating layer containing a pigment and a binder can be provided on the opposite side of the support where the heat-sensitive color-forming layer is coated.

The present invention is further illustrated in more detail by the following Examples, but the present invention should not be limited thereto. In the Examples, all parts are by weight unless otherwise specified.

EXAMPLE 1

Preparation of Heat-sensitive Color Forming Layer

2-Anilino-3-methyl-6-N-metnyl-N-cyclohexylaminofluoran as an electron donating dye precursor, benzyl 4hydroxybenzoate as an electron accepting compound, phenyl 1-hydroxy-2-naphthoate as a heat meltable substance and 4,4'-thio-bis(3-methyl-6-tert-butylphenol) as a color disappearance-preventing agent were used. 20 g of each was dispersed in a ball mill with 100 g of an 5% aqueous solution of polyvinyl alcohol ("PVA-105", trademark for product manufactured by Kuraray Co., Ltd.) for about 24 hours to make volume average particle diameter to 3 μm or lower.

80 g of calcium carbonate ("Unibur 70", trademark for product manufactured by Shiraishi Kogyo Co., Ltd.) as a pigment and 160 g of 0.5% solution of sodium hexamethaphosphate were dispersed in a homogenizer. 5 g of the thus obtaine dispersion of 2-anilino-3-methyl6-N-methyl-N-cyclohexylaminofluoran, 10 g of the thus obtained dispersion of benzyl 4-hydroxybenzoate, 5 g of the thus obtained dispersion of phenyl 1-hydroxy-2-naphthoate, 2 g of the thus obtained dispersion of 4,4'-thio-bis (3-methyl-6-tert-butylphenol) and 22 g of the thus obtained dispersion of calcium carbonate were mixed in thise ratios and 3 g of the 21% emulsion of zinc stearate, 0.6 g of a 40% aqueous solution of glyoxal and 5 g of 2% aqueous solution of sodium di(2-ethylhexyl)sulfosuccinate were further added thereto to prepare a coating composition. The thus obtained coating composition was coated by a wire bar on a high quality paper having weight capacity of 50 g/m$^2$ so that the coating amount after drying was 5 g/m$^2$, and was dried by an oven at 50° C. to obtain a heat-sensitive color forming layer.

Preparation of Protective Layer

On the thus prepared heat-sensitive color forming layer was coated by a wire bar a coating composition which as prepared by mixing 100 g of a 5% solution of polyvinyl alcohol ("PVA 105", trademark for product, manufactured by Kuraray Co., Ltd.) with 15 g the dispersion of heavy kaolin ("Kaobrite", trademark for product, manufactured by Hakudo Kogyo Co., Ltd., oil absorption: 35 ml/100 g), 3 g of 21% emulsion of zinc stearate and 1 g of a 2% aqueous solution of sodium di(2ethylhexyl)sulfosuccinate so that the coating amount after drying was 2 g/m$^2$, dried by an oven at 50° C. and was treated by a super calender so that Bekk smoothness was 800 sec. or more to obtain the heat-sensitive recording material of the present invention.

EXAMPLE 2

The heat-sensitive recording material was prepared in the same manner as in Example 1 except that 0.3 g of glutaraldehyde was used instead of 0.6 g of the 40% aqueous solution of glyoxal.

EXAMPLE 3

The heat-sensitive recording material was prepared in the same manner as in Example 1 except that carboxy-modified polyvinyl aocohol ("PVA KL-318", trademark for product, manufactured by Kuraray Co., Ltd.) was used instead of polyvinyl alcohol ("PVA 105") incorporated in the protective layer in Example 1.

EXAMPLE 4

The heat-sensitive recording material was prepared in the same manner as in Example 1 except that polyvinyl alcohol ("PVA 124", trademark for product, manufactured by Kuraray Co., Ltd.) was used instead of polyvinyl alcohol ("PVA 105") incorporated in the pretective layer in Example 1.

COMPARATIVE EXAMPLE 1

The heat-sensitive recording material was prepared in the same manner as in Example 1 except that the 40% aqueous solution of glyoxal used in Example 1 was not added.

COMPARATIVE EXAMPLE 2

A heat-sensitive recording material was obtained in the same manner as in Example 1 except that 1.0 g of a 40% aqueous solution of glyoxal was added to the coating composition for the protective layer instead of adding to the coating composition for the heat-sensitive color forming layer.

The water-resistance test 1 was carried out by rubbing the color forming surface of a heat sensitive recording material by a water-impregnated applicator for five times to see whether color is formed or not in a oven at 100° C. Color forming density was measured by Macbeth reflective densitometer RD-918. In cases when the heat-sensitive recording material had low color forming density, it is believed that the protective layer and color forming layer were damaged.

The water-resistance test 2 was carried out by copying a CCITT test chart No. 2 on the heat-sensitive recording material by using a thermal printer, LIF-2, manufactured by Matsushita Denso Co., Ltd., soaking the material in water for 24 hours, and then checking the state of the printed letters.

The results thereof are shown in Table 1.

TABLE 1

| Sample No. | Water-resistance Test 1 | Water-resistance Test 2 |
|---|---|---|
| Example 1 | B | B' |
| Example 2 | B | B' |
| Example 3 | A | B' |
| Example 4 | B | A' |
| Comparative Example 1 | D | C' |
| Comparative Example 2 | A | C' |

Three basis of evaluation on the water-resistance tests are as follows.
Water resistance test 1
A: excellent, the color forming density is 1.2 or more.
B: good, the color forming density is from 1.0 to 1.2.
C: acceptable for practical use, the color forming density is from 0.7 to 1.0.
D: unacceptable for practical use, the color forming density is 0.7 or less.
Water resistance test 2
A': printed letters are clearly recognized and suitable for practical use.
B': printed letters are recognizable and acceptable for practical use.
C': printed letters are unrecognizable and unacceptable for practical use.

As is apparent from Table 1, the heat-sensitive recording material according to the present invention has excellent water resistance either before recording or after recording.

While the invention has been described in detail and with reference to specific embodiments thereof, it will be apparent to one skilled in the art that various ges and modifications can be made therein without departing from the spirit and scope thereof.

What is claimed is:

1. A heat-sensitive recording material produced by a process comprising providing on a support a heat-sensitive color forming layer containing a colorless or slightly colored electron donating dye precursor, an electron accepting compound which is capable of forming color by reaction with said electron donating dye precursor and a hardening agent which is capable of hardening a binder in a protective layer by reaction with said binder, and providing on said color-forming layer a protective layer containing a binder and no hardener.

2. A heat-sensitive recording material as in claim 1, wherein the binder in the protective layer is a water-soluble polymer.

3. A heat-sensitive recording material as in claim 2, wherein said water-soluble polymer is selected from the group consisting of methyl cellulose, carboxymethyl cellulose, hydroxyethyl cellulose, starches, gelatin, gum arabic, casein, a hydrolysis product of styrene-maleic anhydride copolymer, a hydrolysis product of ethylene-maleic anhydride copolymer, a hydrolysis product of isobutylene-maleic anhydride copolymer, polyvinyl alcohol, carboxy-modified polyvinyl alcohol, silanol-modified polyvinyl alcohol, and polyacrylamide.

4. A heat-sensitive recording material as in claim 3, wherein said water-soluble polymer is selected from the group consisting of polyvinyl alcohol, carboxy-modified polyvinyl alcohol, and silanol-modified polyvinyl alcohol.

5. A heat-sensitive recording material as in claim 4, wherein the hardening agent is a water-soluble initially condensed resin, a dialdehyde compound, an inorganic cross linking agent, polyacrylic acid, methylvinylether-maleic acid copolymer, and isobutylenemaleic anhydride copolymer.

6. A heat-sensitive recording material as in claim 5, wherein the hardening agent is present in an amount of from 0.5 to 30 wt % based on the weight of binder in the protective layer.

7. A heat-sensitive recording material as in claim 5, wherein the hardening agent is present in an amount of from 2 to 10 wt % based on the weight of binder in the protective layer.

8. A heat-sensitive recording material as in claim 4, wherein said hardening agent is selected from N-methylol melamine, a dialdehyde compound, and a water-soluble initial condensate of urea and formaldehyde.

9. A heat-sensitive recording material as in claim 8, wherein the hardening agent is present in an amount of from 0.5 to 30 wt % based on the weight of binder in the protective layer.

10. A heat-sensitive recording material as in claim 8, wherein the hardening agent is present in an amount of from 2 to 10 wt % based on the weight of binder in the protective layer.

11. A heat-sensitive recording material as in claim 1, wherein the hardening agent is a water-soluble initially condensed resin, a dialdehyde compound, an inorganic cross linking agent, polyacrylic acid, methylvinylether-maleic acid copolymer, and isobutylenemaleic anhydride copolymer.

12. A heat-sensitive recording material as in claim 11, wherein the hardening agent is present in an amount of from 0.5 to 30 wt % based on the weight of binder in the protective layer.

13. A heat-sensitive recording material as in claim 11, wherein the hardening agent is present in an amount of from 2 to 10 wt % based on the weight of binder in the protective layer.

14. A heat-sensitive recording material as in claim 1, wherein said hardening agent is selected from N-methylol melamine, a dialdehyde compound, and a watersoluble initial condensate of urea and formaldehyde.

15. A heat-sensitive recording material as in claim 14, wherein the hardening agent is present in an amount of from 0.5 to 30 wt % based on the weight of binder in the protective layer.

16. A heat-sensitive recording material as in claim 14, wherein the hardening agent is present in an amount of from 2 to 10 wt % based on the weight of binder in the protective layer.

* * * * *